US005645434A

United States Patent [19]

Leung

[11] Patent Number: 5,645,434

[45] Date of Patent: Jul. 8, 1997

[54] CONNECTOR ELEMENT AND COMPONENT ARRANGEMENT FOR A STACKABLE COMMUNICATIONS NETWORK HUB

[75] Inventor: Tommy Y. Leung, San Jose, Calif.

[73] Assignee: Asante Technologies, Inc., San Jose, Calif.

[21] Appl. No.: 565,911

[22] Filed: Dec. 1, 1995

[51] Int. Cl.[6] ..... H01R 13/648

[52] U.S. Cl. ..... 439/74; 361/735; 439/928

[58] Field of Search ..... 439/928, 74, 69

[56] References Cited

U.S. PATENT DOCUMENTS

| | | | |
|---|---|---|---|
| 4,589,063 | 5/1986 | Shah et al. . | |
| 4,969,830 | 11/1990 | Daly et al. | 439/136 |
| 4,981,438 | 1/1991 | Bekhiet | 439/76 |
| 5,038,320 | 8/1991 | Heath et al. . | |
| 5,156,556 | 10/1992 | Ma | 439/928 |
| 5,265,238 | 11/1993 | Canova, Jr. et al. . | |
| 5,371,897 | 12/1994 | Brown et al. . | |
| 5,404,460 | 4/1995 | Thomsen et al. . | |
| 5,408,616 | 4/1995 | Murr . | |
| 5,440,181 | 8/1995 | Gruender, Jr. et al. . | |
| 5,442,644 | 8/1995 | Heflin et al. . | |
| 5,463,741 | 10/1995 | Levenstein . | |
| 5,467,453 | 11/1995 | Kocis . | |
| 5,491,830 | 2/1996 | Ferri . | |

*Primary Examiner*—Neil Abrams
*Assistant Examiner*—Eugene Byrd
*Attorney, Agent, or Firm*—Burns, Doane, Swecker & Mathis, LLP

[57] ABSTRACT

A connector element and electronic component arrangement in which the connector element cooperates with receiving slots provided in first and second electronic components to electrically connect the components. The connector element includes ground traces and signal traces which are brought into electrical contact with signal leads and ground leads of the electronic components when the connector element is inserted into the receiving slots located in the first and second electronic components. Multiple electrical components may be electrically connected in a stack using multiple connector elements which cooperate to form a substantially continuous bus. The connector element and electronic component arrangement eliminates the signal delay, signal reflection, and interference associated with data cables.

16 Claims, 4 Drawing Sheets

CONNECTOR ELEMENT AND COMPONENT ARRANGEMENT FOR A STACKABLE COMMUNICATIONS NETWORK HUB

FIELD OF THE INVENTION

The present invention is directed generally toward communications network connections. More particularly, the present invention relates to a connector element and an electrical component arrangement for a stackable communications network hub.

BACKGROUND OF THE INVENTION

In a communications network, large numbers of components such as computers, workstations, or file servers, are electrically connected by a communication network technology such as ethernet, asynchronous transfer mode (ATM), fiber distributed data interface (FDDI), a technology known as TP-PMD (the copper-wire derivative of FDDI), and a networking technology known as 100VG-AnyLAN, which uses an access method called demand priority access method (DPAM). An ethernet or other communication network typically includes a hub which is connected to the of components by communication cables, and which allows the computers, workstations, or file servers to exchange data signals. Data signals sent from a transmitting component to a receiving component are transmitted to the hub and repeated at the hub for transmission to the receiving component. The hub enables multiple computers, workstations, or file servers to share resources in a variety of applications. These applications include client-server database systems, in which a back-end database "engine" handles queries from multiple client front-ends running on desktop personal computers. The volume of data carried over the communication network escalates considerably as new users, new applications software, and more powerful computers or workstations are added to the network. As the volume of data carried over the network increases toward the maximum capacity, the data transfer rate through the hub and communication cables decreases, causing delays in computer applications and severely reducing the effectiveness of the network. Further, as the number of users associated with a network increases, more access ports are needed. To alleviate this problem, it is highly desirable to increase the capacity and/or the speed of the network.

A typical network hub includes one or more devices for routing data transfers between a number of ports (e.g., 12) in a workgroup. Each port may be assigned to one or more individual users or one or more individual computers, workstations, or servers. To increase the number of ports available to a workgroup, multiple hubs may be connected. Hub connections are typically achieved by uplink cables, such as unshielded twisted pair (UTP) cables, shielded twisted pair (STP) cables, or fiber optic cabling. In large, complex networks, a significant number of cables may be required. Cables present significant design limitations. For example, the total length of cable between hub units in a high-speed (e.g., 100 megabits per second) network must be less than 205 meters, and the total length of cable from a hub unit to a computer or other component must be less than 100 meters. Because of the length limitations of cables, the number of network hubs which may be interconnected is limited. Further, cables cause signal delay which can contribute to delays in network applications; thus, longer cables cause increased delay. In addition, signal reflection occurs at cable termination or connection points; thus, an increased number of cables causes increased delay. The reflected signals at the cable termination points contribute to signal degradation and inhibit network performance. The signal reflection and signal delay associated with cables also limit the number of network hubs which may be interconnected. A further limitation of cables is that it can be difficult, particularly for large cables, to provide adequate shielding for protecting the signals carried by a cable from the effects of RF interference. These and other limitations of cables become more pronounced as the speed of the communications network increases.

Accordingly, it would be desirable to eliminate or reduce the length and number of data cables required to implement a high-speed, high-bandwidth communications network. It would be further desirable to eliminate or reduce delay and/or signal reflection in a high-speed communications network. It would further be desirable for a high-speed communications network to allow an increased number of network hubs or other electronic control components to be easily and reliably interconnected in a communications network.

SUMMARY OF THE INVENTION

In order to solve the above-described problems, and provide other advantages, the present invention provides for a connector element and electronic component arrangement in which an increased number of electronic components, such as ethernet network hubs, may be quickly and simply connected without cables, thereby reducing or eliminating the signal delay and signal reflection associated with cables and conventional shielding methods. According to exemplary embodiments, the connector element of the present invention includes a substantially rectangular, plate-like connector body which cooperates with substantially identical receiving slots located in each of the electronic components to be connected. Electrical traces including signal traces and ground traces are printed on the connector body. The signal traces and ground traces are brought into electrical contact with signal terminals and ground terminals, respectively, located within the receiving slot of an electrical component when the connector element is inserted into the receiving slot. Multiple electrical components may be connected together in a stacked arrangement using multiple connector elements each connector element cooperating with a receiving slot in each of the electrical components. The multiple connector elements in the stacked arrangement cooperate with the electrical components to form a substantially continuous bus for conducting signals between the electrical components and associated devices.

According to other embodiments of the present invention, the connector element includes an alignment means, such as one or more slotted grooves, to ensure that the ground traces are brought into electrical contact with the ground terminals, and the signal traces are brought into electrical contact with the signal terminals, when the connector element is inserted into a receiving slot. According to a further embodiment of the present invention, the connector body is made of a dielectric material, and has dimensions selected to match the impedance of the connector element to the frequency of the signals present on the signal contacts. The connector element can include an inner layer containing electrically conductive signal leads for conducting signals between signal traces, a dielectric layer surrounding the inner layer, and conductive layers located on portions of the dielectric layer. The conductive layers can be grounding shields to provide the connector with RF shielding.

BRIEF DESCRIPTION OF THE DRAWINGS

A more complete understanding of the invention may be obtained upon review of illustrative examples contained in the following Detailed Description of the Preferred Embodiments, in conjunction with the accompanying drawings in which like reference numerals indicate like elements and in which.

DETAILED DESCRIPTION OF THE PREFERRED EMBODIMENTS

Figure 1:
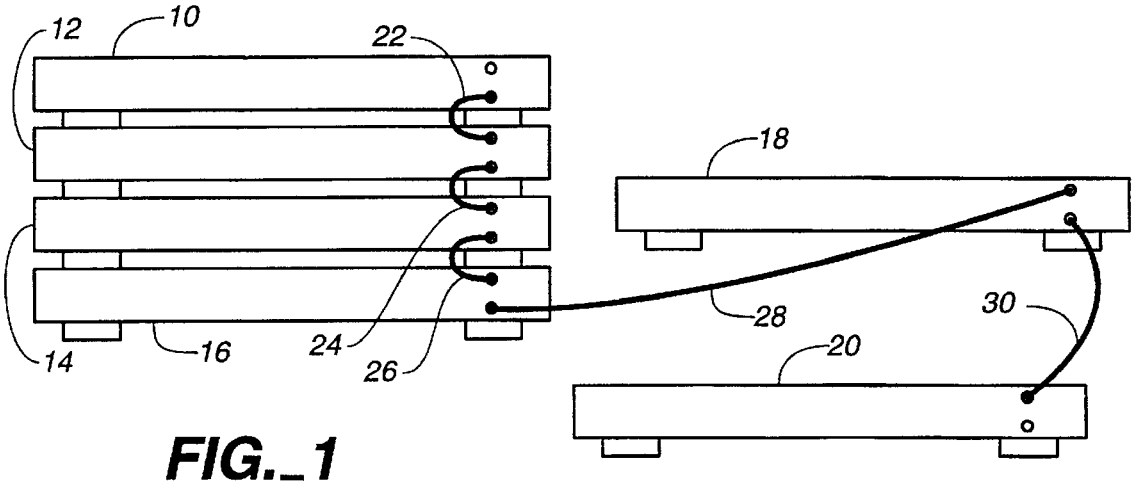
FIG. 1 (PRIOR ART)
FIG. 1 is a diagram showing an arrangement of electronic components connected in a manner known in the art.

Referring now to FIG. 1, a conventional arrangement of electronic components connected by cables is shown. Electronic components 10, 12, 14, 16, 18 and 20 are connected by cables 22, 24, 26, 28 and 30. Components 10, 12, 14 and 16 are stacked one on top of another and connected by cables 22, 24, and 26. Cable 22 electrically connects electronic components 10 and 12, cable 24 electrically connects electronic components 12 and 14, and cable 26 electrically connects electronic components 14 and 16. Components 18 and 20 are spaced apart from the stack of components 10, 12, 14 and 16. Cable 28 electrically connects components 16 and 18, and cable 30 electrically connects components 18 and 20. Components 10, 12, 14, 16, 18 and 20 may be control components, such as an intelligence module or bridging module, of a hub for an ethernet or other high-speed data network. Cables 22, 24, 26, 28 and 30 may be unshielded twisted pair (UTP) cables for transferring data between components. Each cable 22, 24, 26, 28 and 30 has an inherent data transfer delay. If the cables are relatively thick, they may not be provided with sufficient shielding and the signals carried by the cable may be subject to the effects of RF interference. Signal reflection may occur at the terminal points of the cables 22, 24, 26, 28 and 30. Due to the signal reflection, RF interference, and delay associated with the cables, the number of components which may be interconnected in a network is limited.

Figure 2A:
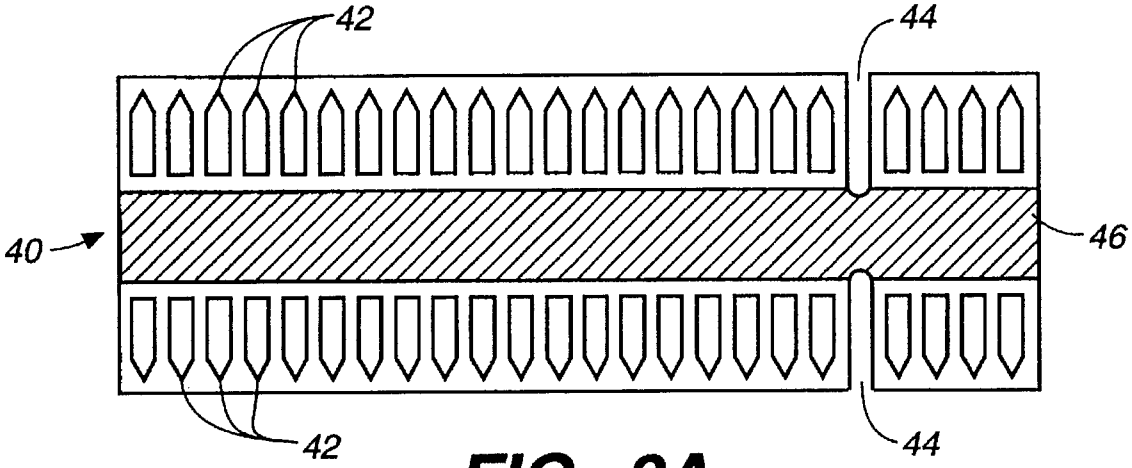
FIGS. 2A–B are diagrams showing perspective and cross-sectional views, respectively, of a connector element according to one embodiment of the present invention.

Referring now to FIG. 2A, a perspective view showing a face of a connector element 40 according to one embodiment of the present invention is shown. The connector element 40 has a substantially rectangular body, and electrical traces 42 are disposed on the connector element 40, such as by printing. The electrical traces 42 include ground traces and signal traces which are brought into electrical contact with ground contacts and signal contacts, respectively, of an electrical component when the connector element 40 is inserted into in the receiving slots provided in the electrical component. The connector element 40 can be provided with one or more slotted grooves such as slotted grooves 44. The slotted grooves 44 provide an aligning means to ensure that the ground traces and signal traces are brought into electrical contact with the appropriate ground contacts and signal contacts, respectively, when the connector element is inserted into a receiving slot of an electrical component. It will be appreciated that other suitable aligning means, such as bumps located on the surface of the connector element 40 or projections extending from the connector element 40, can be used instead of the slotted grooves 44. It will be further appreciated that the signal traces and ground traces comprising signal traces 42 may be arranged so that no aligning means is necessary. The connector element 40 can also be provided with a layer 46 of electrically conductive material located on a portion of each face of the connector element 40. The electrically conductive layer 46 serves as a grounding shield to protect the connector element from the effects of RF interference.

Figure 2B:
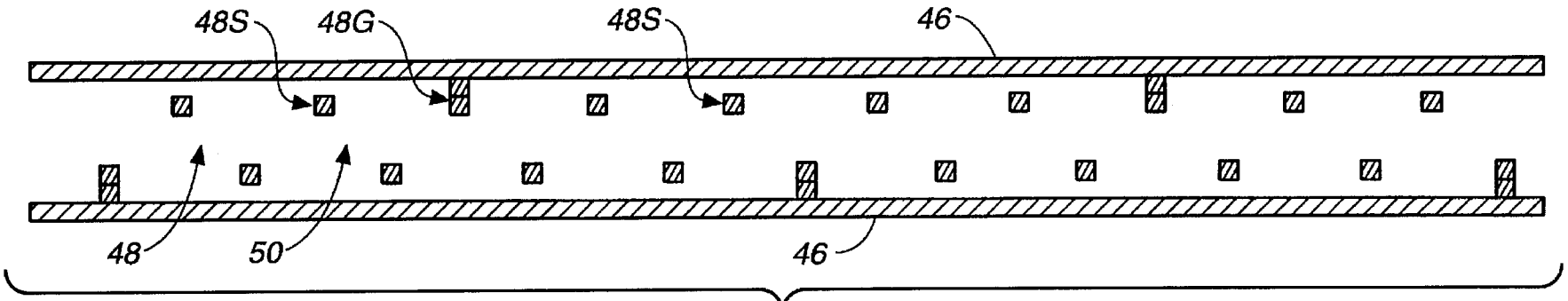

Referring now to FIG. 2B, a cross-sectional view of the connector element 40 is shown. The connector element 40 includes an inner layer 48 which contains dielectric material 50 and electrically conductive signal leads 48G and 48S for appropriately conducting electrical signals between ground traces and between signal traces, respectively. Signal leads 48G and 48S can be formed, for example, by depositing copper layers on inner layer 48 and etching the copper layer to form signal leads 48G and 48S. The inner layer 48, and signal leads 48G and 48S, are surrounded by the dielectric material 50, and the signal traces 42 (not shown) are printed on the edges of each surface of the dielectric material 50. Signal leads 48G and 48S are appropriately connected between ground traces and signal traces, respectively, through dielectric material 50. Conductive layers 46 are provided on portions of opposite surfaces of the connector element 40 as grounding RF shields. Signal leads 48G are connected to ground shields 46 as shown. The conductive layers 46 preferably cover at least the portions of the connector element 40 which are exposed between the interconnected components. It will be appreciated that the connector element 40 is constructed so as to form a microstrip which is protected from RF interference by the grounding shields 46. It will be further appreciated that the dimensions of the dielectric material 50 and the dimensions of the signal leads 48G and 48S may be selected to ensure that the impedance of the connector element 40 matches the impedance of the driving circuits of the electrical components to be connected. By tuning the impedance of the connector element 40, signal reflection and degradation is significantly less than that in network hubs which use conventional cables.

Figure 3:
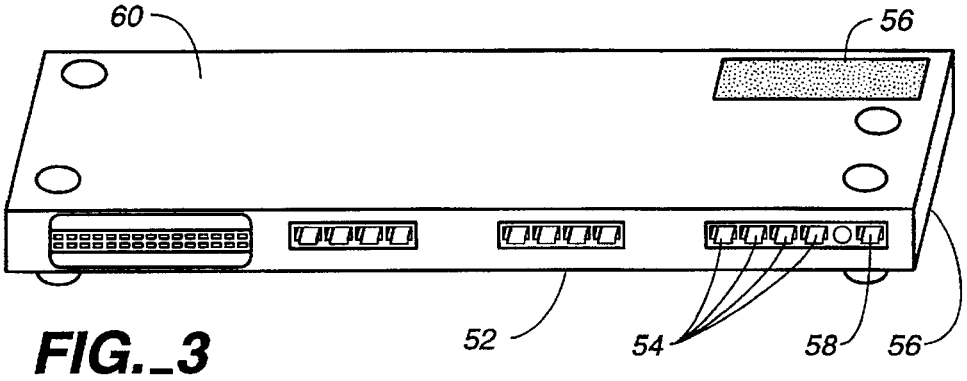
FIG. 3 is a diagram of an electronic component having a slot for receiving the connector element of FIG. 2.

Referring now to FIG. 3, an electrical component for use with the connector element 40 is shown. The electrical component shown is in the form of an network hub 52 for routing communication signals between networked electrical devices such as servers, workstations, or computers. It will be appreciated that many other types of electrical components may be adapted for use with the connector element of the present invention. The ethernet hub 52 includes a plurality of communication ports 54 for connecting to communication cables associated with the networked devices. The network hub 52 also includes two receiving slots 56 for receiving a connector element 40. The receiving slots 56 are preferably located on opposite surfaces of the hub 52 so as to allow a group of hubs 52 to be interconnected in a stacked configuration. Each receiving slot 56 contains signal contacts and ground contacts (not shown) for connection to the ground traces and signal traces on the connector element 40. Each receiving slot 56 can also be provided with an aligning element such as one or more bumps, slots, etc. to cooperate with corresponding aligning elements located on the connector element 40, and thereby ensure proper alignment of the electrical traces on the connector element with the electrical contacts in the receiving slot. The receiving slots 56 can be provided with a protective covering (not shown) to prevent the electrical contacts of the hub 52 from being exposed. The hub 52 also can include an uplink port 58 for connecting various stacks of network hubs. The hub 52 also includes a power terminal 60 for receiving power.

Figure 4A:
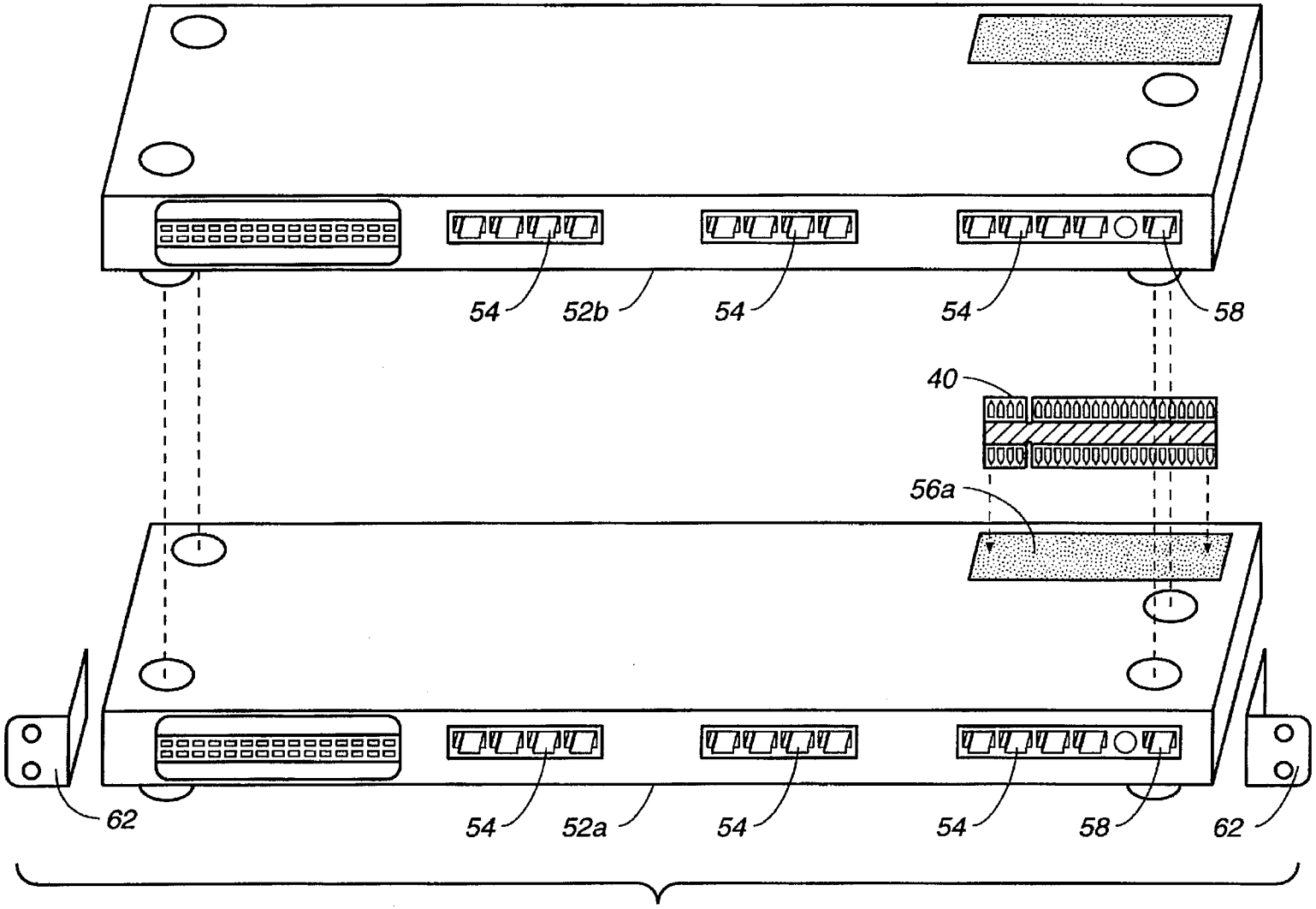
FIGS. 4A–B are diagrams showing a method for connecting electronic components and an arrangement of connected electronic components, respectively, according to one embodiment of the present invention.
Figure 4B:
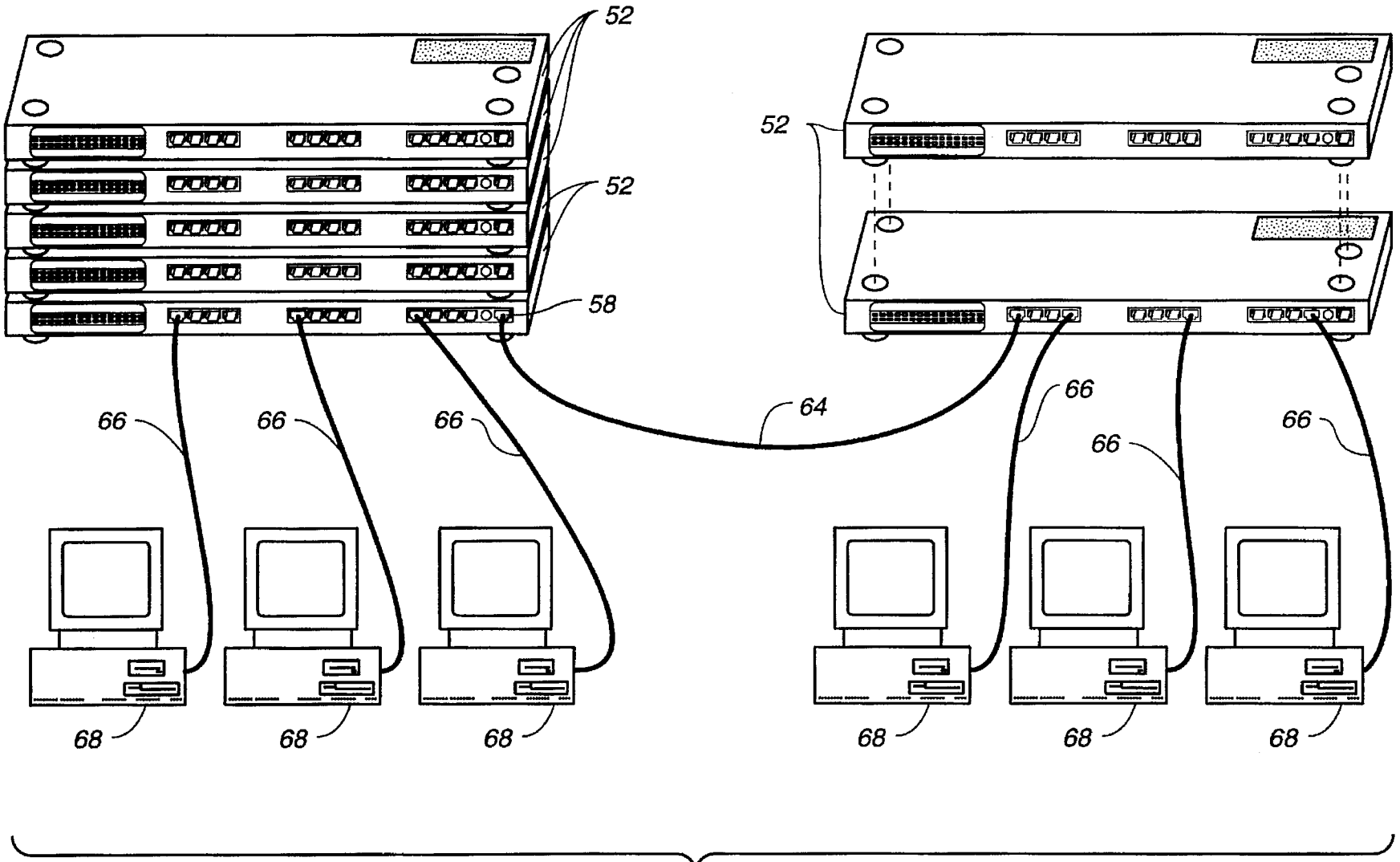

Referring now to FIGS. 4A–B, a method for interconnecting hubs, and an arrangement of interconnected hubs, respectively, according to one embodiment of the present invention are shown. To connect two hubs, a connector element 40 is inserted into a receiving slot 56*a* on the top surface of a first hub 52*a*. A receiving slot (not shown) on the bottom surface of a second hub 52*b* is aligned with the connector element 40, and the second hub is fitted onto the connector element 40 to electrically connect the two hubs. More hubs may be added to the stack, either beneath the first hub or above the second hub. Brackets 62 or other suitable retaining elements may be used to provide structural integrity to a stack of hubs. The signal traces, ground traces and grounding shields of each connector element 40 used in the stack cooperate with the hubs to form a substantially continuous bus for communicating signals between the hubs in the stack. Because the connector elements 40 connecting the hubs form a microstrip which is shielded from the effects of RF interference by grounding shields 46, and because the dimensions of the connector bodies can be selected to match the impedance of the connector elements and the network hubs to reduce signal reflection, the substantially continuous bus formed by the connector elements and the network hubs in the stack may accommodate a relatively large number (e.g., 16) of network hubs. Further, additional stacks of large numbers of hubs may be functionally connected together by uplink communication cables, such as cable 64, inserted into the uplink communication port 58 of any of the hubs in an interconnected stack, as shown in FIG. 4B. Standard data cables 66 connect the network hubs 52 to the network devices 68.

In accordance with the exemplary embodiments of the invention, relatively large numbers of network hubs or other electrical components may be interconnected to serve an increased number of network users without the signal delay, reflection, and interference associated with data cables.

While the foregoing description has included many details and specificities, it is to be understood that these are for illustrative purposes only, and are not to be construed as limitations of the present invention. Numerous modifications will be readily apparent to those of ordinary skill in the art which do not depart from the spirit and scope of the invention, as defined by the following claims and their legal equivalents.

What is claimed is:

1. A connector element for electrically connecting communication network hubs, comprising:

an inner layer containing electrically conductive signal leads;

an outer layer surrounding the inner layer, the outer layer having first and second surfaces, each surface having electrical traces disposed thereon which are connected to the signal leads, the electrical traces including ground traces and signal traces;

first and second conductive layers located on portions of the first and second surfaces of the outer layer, wherein the connector element is capable of cooperating with receiving slots in each of two communication network hubs to electrically connect the two communication network hubs, each receiving slot having ground contacts and signal contacts which are brought into electrical contact with ground traces and signal traces, respectively, when the connector element cooperates with the receiving slots, and the first and second conductive layers provide RF shielding in a region between the two communication network hubs.

2. The connector element of claim 1, wherein the electrical components are ethernet network hubs.

3. The connector element of claim 2, wherein the connector element includes alignment means for ensuring that the ground traces are electrically connected to the ground contacts, and the signal traces are electrically connected with the signal contacts, when the connector element cooperates with the receiving slots of two ethernet network hubs.

4. The connector element of claim 2, wherein the receiving slots are substantially identical.

5. The connector element of claim 1, wherein the outer layer is a dielectric material and the electrical traces are printed on the dielectric material.

6. The connector element of claim 5, wherein the connector element has an impedance which may be tuned to the frequency of signals on the signal contacts to reduce signal reflection.

7. The connector element of claim 6, wherein the impedance of the connector element is tuned to the frequency of the signals on the signal contacts by varying the dimensions of the signal traces.

8. The connector element of claim 2, wherein n connector elements cooperate with the receiving slots of n+1 ethernet network hubs.

9. The connector element of claim 8, wherein the ground planes, ground traces and signal traces of the n connector elements form a substantially continuous signal bus.

10. The connector element of claim 1, wherein the connector body is in the form of a substantially rectangular plate.

11. The connector element of claim 1, wherein the first and second conductive layers are grounding shields.

12. The connector element of claim 3, wherein the alignment means comprises one or more slotted grooves in the connector element.

13. A hub for exchanging signals in a communications network, comprising:

a hub body having a plurality of communication ports, each port capable of exchanging communication signals between the hub body and a network device, the hub body having one or more receiving slots containing a plurality of electrical contacts, each receiving slot cooperating with a connector element having shielding means and electrical traces provided thereon such that the electrical traces are brought into electrical contact with the electrical contacts of the receiving slot when the connector element is inserted into the receiving slot and that RF shielding is provided in a region between two hubs.

14. The hub of claim 13, wherein the electrical traces include signal traces and ground traces, and the electrical contacts include ground contacts and signal contacts.

15. The hub of claim 14, further comprising an aligning element located in each receiving slot, the aligning element cooperating with a corresponding aligning means located on the connector element to ensure that the signal traces and ground traces of the connector element are brought into electrical contact with the signal contacts and ground contacts of the receiving slot, respectively.

16. The hub of claim 13, wherein the hub is an ethernet network hub.

* * * * *